United States Patent [19]

Seitsonen et al.

[11] Patent Number: 5,047,773

[45] Date of Patent: Sep. 10, 1991

[54] PROCEDURE FOR THE GENERATION OF CONTROL SIGNALS IN A PUSH BUTTON BOX, AND A PUSH BUTTON BOX DESIGNED FOR IMPLEMENTING THE PROCEDURE

[75] Inventors: Juha Seitsonen, Hangonkyla; Olavi Jussila, Hyvinkaa, both of Finland

[73] Assignee: Kone Oy, Helsinki, Finland

[21] Appl. No.: 454,996

[22] Filed: Dec. 22, 1989

[30] Foreign Application Priority Data

Dec. 22, 1988 [FI] Finland ..... 885938

[51] Int. Cl.[5] ..... G08C 19/12; H01H 21/24; B66C 13/40

[52] U.S. Cl. ..... 341/176; 200/557; 212/160; 335/207; 340/685

[58] Field of Search ..... 341/176; 340/693, 685, 340/539, 533–534, 551, 686; 200/404, 553, 557; 212/160, 165; 455/66, 70; 335/205–207; 74/471 XY

[56] References Cited

U.S. PATENT DOCUMENTS

| | | | |
|---|---|---|---|
| 3,265,826 | 8/1966 | Autry et al. | 335/205 |
| 3,906,369 | 9/1975 | Pitman et al. | 341/176 X |
| 4,078,667 | 3/1978 | Navarro | 212/160 X |
| 4,201,489 | 5/1980 | Zapp | 335/207 X |
| 4,296,394 | 10/1981 | Ragheb | 335/207 |
| 4,366,463 | 12/1982 | Barker | 338/69 |
| 4,489,297 | 12/1984 | Haydon et al. | 335/207 |
| 4,646,087 | 2/1987 | Schumann | 74/471 X YX |

FOREIGN PATENT DOCUMENTS

| | | |
|---|---|---|
| 3008561 | 3/1980 | Fed. Rep. of Germany . |
| 2518359 | 6/1983 | France . |
| 2010588 | 6/1979 | United Kingdom . |

*Primary Examiner*—Glen R. Swanni, III
*Assistant Examiner*—Thomas J. Mullen, Jr.
*Attorney, Agent, or Firm*—Fleit, Jacobson, Cohn, Price, Holman & Stern

[57] ABSTRACT

In a method for the generation of control signals in a push button box and transmission of the signals for the control of a machine, signals representing the position of a push button element are transferred by a non-contacting mode from the push button element to a signal generating unit, which is adapted to produce control signals proportional to the position of the push button element. A push button box for carrying out the method comprises at least one push button element, a signal generating unit adapted to receive the signals representing the position of the push button element by non-contacting mode, and further adapted to generate control signals proportional to the position of each of the push button elements, and a partition between each push button element and the signal generating unit.

19 Claims, 3 Drawing Sheets

PROCEDURE FOR THE GENERATION OF CONTROL SIGNALS IN A PUSH BUTTON BOX, AND A PUSH BUTTON BOX DESIGNED FOR IMPLEMENTING THE PROCEDURE

BACKGROUND OF THE INVENTION

The present invention relates to a procedure for generating the control signals in a push button box designed e.g. for the control of a crane, said push button box comprising at least one push button element, and to a push button box designed for implementing the procedure.

For generating two-step, multi-step or stepless control signals, there is currently no light-weight push button box of absolutely air-and-watertight construction that would also be suited for one-hand control. Such a control box is needed e.g. for an overhead travelling crane provided with a hanging push button box for stepless or stepwise motion control.

In certain push button boxes in current use, two-step or multi-step control is based on the utilization of the time differences between the contact actions of contact elements located at different levels in the direction of depression. In such a solution, contact elements located at different levels produce an output signal at different instants depending on the depth of depression of the button. There are also control boxes that use a handle mounted on a shaft passing through the box and, when the handle is turned, actuating a contact element with several contacts in the box in a stepwise manner, functioning much like a camshaft. The shaft may also be used to drive a signal source, such as a potentiometer, which supplies a stepless or a stepwise signal that is dependent on the angle of displacement of the control handle.

In special environments, e.g. wet spaces or spaces containing explosive substances, where the push button box has to be well sealed, the sealing increases the cost because every hole made in the box shell for the control gear has to be separately sealed in accordance with the environmental classification of the locality in question.

The motion required for the depression of single-step push buttons can nowadays be transmitted through a membrane or a flexible covering on the contact elements, thus rendering the enclosure of the push button box sufficiently tight and obviating the need for making and sealing a hole. There are also push buttons which use the Hall effect to produce 0–1 signals. Employing this principle makes it possible to achieve a good tightness of the box enclosure, because the push button incorporates no moving parts. Further, DE-patent publication 3008561 proposes a push button construction based on the bistable nature of a magnetic field. However, these principles cannot be reasonably applied to construct push buttons with multi-step or stepless control signal functions for use in enclosed control boxes.

A normal requirement concerning a push button used for stepless or stepwise control of crane movements is that it should give the user a good feel of the position of the operating arm employed. This feature is difficult to implement with currently used push button constructions because the feel of position in these constructions depends on several factors, e.g. possible bearing suspension of the operating arm and of the shaft going through the control box, counter forces presented by the contact element, etc.

In the control box constructions currently used, the relatively large size of the contact elements for stepwise control or of the signal transducer for stepless control, the shafts going through the box enclosure and the sealing arrangements needed to ensure a tightness corresponding to the environmental conditions, and the devices needed to produce the required feel of step are all factors increasing the weight of the control box. Besides being heavy, such a control box is ill adapted for one-hand operation.

The object of the present invention is to eliminate the drawbacks referred to above and to achieve a push button control box construction that provides an improved tightness of enclosure and a better feel of operating arm position and is also light enough to enable the control box to be used without difficulty with one hand only.

STATEMENT OF INVENTION

The invention therefore provides a push button box and a procedure for the use thereof to meet the above and further objects.

The invention provides a method for the generation of control signals in a push button box and transmission of said signals for control of a machine, wherein signals representing the position of at least one push button element are transferred by a non-contacting means from said element to a signal generating unit, which is adapted to produce control signals proportional to the position of said push button element.

The invention further provides a push button box for the generation of control signals for a machine and transmission of said signals by a transmission means, comprising at least one push button element, a signal generating unit adapted to receive the signals representing the position of said at least one push button element by a non-contacting means, and further adapted to generate control signals proportional to the position of each said push button element, and partition between each said push button element and said signal generating unit.

The invention provides the following advantages over existing push button boxes:

Improved tightness of the control box construction, resulting from the fact that no actuating elements penetrating the box enclosure are used.

Long functional life, resulting from the fact that the control box of the invention employs no movable electrical actuating elements. Therefore, the durability of the device of the invention is determined by the durability of the rocker arm of the push button, typically of the order of 20°–10° operations.

Light weight, resulting from the absence of contact elements and the use of a small-size card-mounted electronic component for detecting the push button position.

Excellent feel of position of the push button element, resulting from the fact that the equipment determining the feel, such as counter springs and the rasters needed for stepwise control, can now be manufactured considering only the requirements dictated by the desired feel of position. Thus, the construction of the invention is free of the frictional forces, counter forces of contact elements etc. affecting the feel of position in existing constructions.

Good ergonomic properties of the push button box, resulting from the fact that the box construction lends itself to effective utilization of the wrist and thumb motions suited for actuating a lever resembling a rocker arm.

DESCRIPTION WITH REFERENCE TO DRAWINGS

The invention is now further described in detail with reference to the drawings, in which FIGS. 1*a* and 1*b* illustrate the construction of the push button box of the invention as applied for the control of three crane movements;

FIGS. 2*a* and 2*b* illustrate the construction of a single push button in the push button box of the invention; and FIG. 3 illustrates the signal processing in the push button box of the invention.

DESCRIPTION OF THE PREFERRED EMBODIMENTS

Figure 1A:
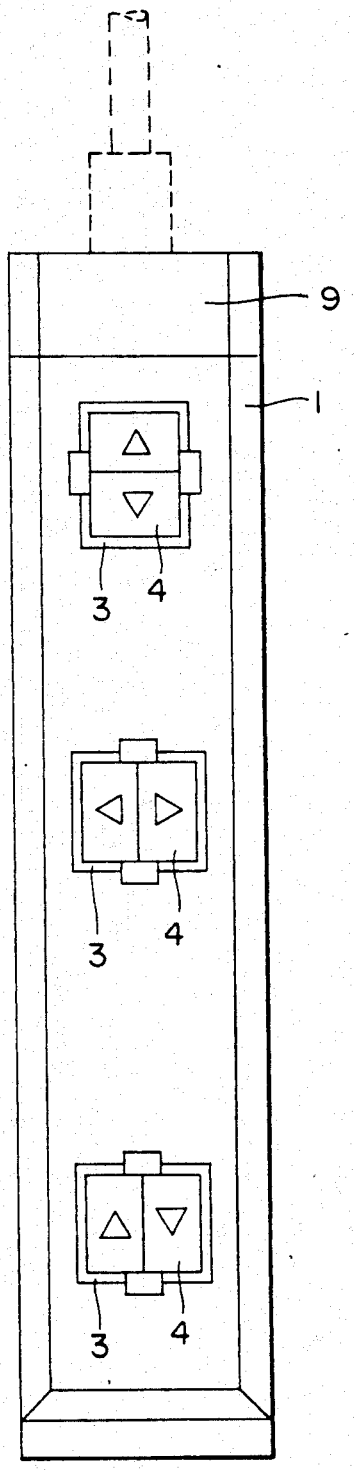
Figure 1B:
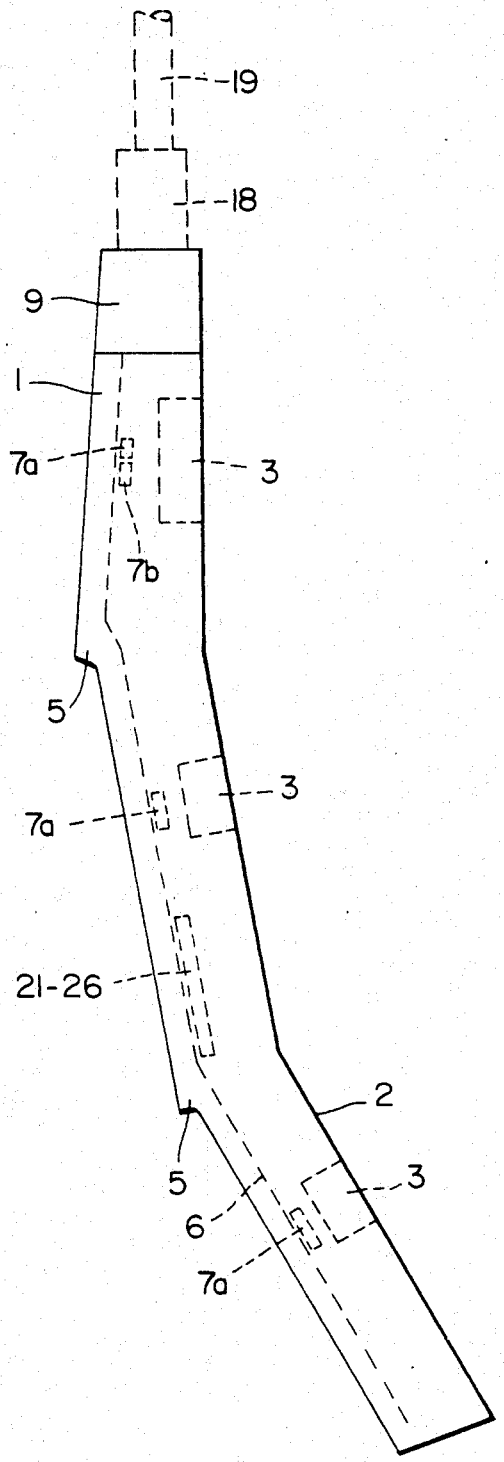

FIG. 1*a* is a front view and FIG. 1*b* a lateral view of the push button box 1, the enclosure 2 of which is provided with cup-shaped cut-outs 3 in which the push buttons 4 are mounted. The rear side of the enclosure 2 of the push button box 1 is provided with finger stoppers 5 designed to help the user get a firm and correct grip of the control box. Inside the control box 1 is a circuit card 6 which accommodates four position sensing elements 7*a* and 7*b* for each button. These sensor elements perceive the position of the button 4 through the enclosure 2 forming partition 2*a* of the control box 1. The circuit card 6 also accommodates a signal processing circuit 21–26 which takes care of further processing of the signal provided by the position sensors 7*a*, 7*b*. The push button box 1 can be equipped as a wireless control box, in which case it is provided with a radio transmitter 9 with an antenna either inside or outside the box. For crane control, the signals can be transmitted to the crane, preferably in serial form through a cable 19, the box enclosure 2 being provided with a cable gland 18. Instead of a radio transmitter 9, it is also possible to use other types of wireless transmitter, e.g. an infrared transmitter or an induction transmitter.

Figure 2A:
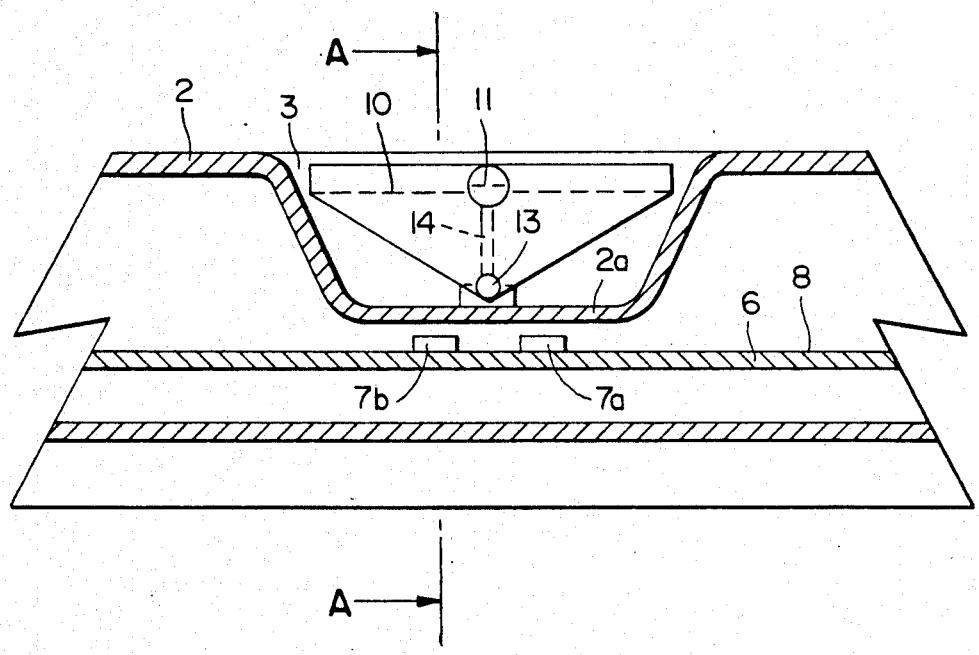
Figure 2B:
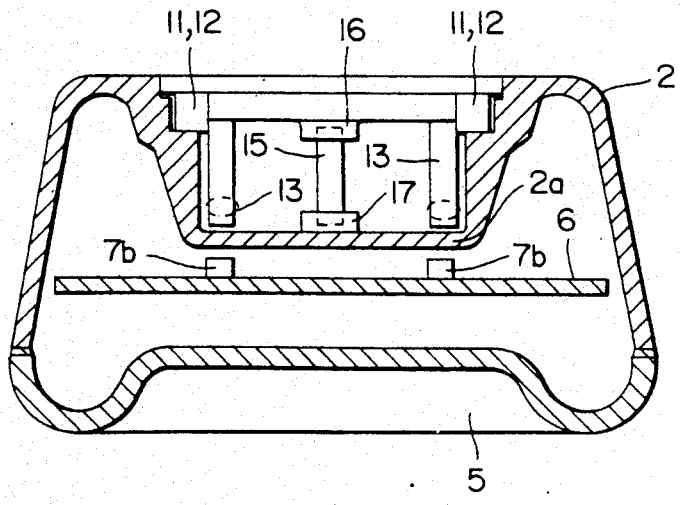

FIG. 2*a* shows a lateral view of a push button 4 placed in a cup-shaped cut-out 3 in the enclosure 2 of the control box 1 and FIG. 2*b* a section along the line A—A in FIG. 2*a*. The push button 4 comprises a rocker arm 10 mounted on a shaft 11 supported by bearings in bearing housings 12 in the box enclosure 2. Attached to the rocker arm 10 are two magnets 13 which, when either end of the rocker arm 10 is depressed, move orbitally about the shaft 11, resulting in a change in their distance from the circuit card 6 and the four sensor elements 7*a*, 7*b* measuring the magnetic field. The use of two magnets 13 and four sensors 7*a*, 7*b* measuring the magnetic field ensures that the magnitude and direction of the change of the field are correctly interpreted by the signal processing circuit 21–26, although in principle one magnet and two field measuring elements would suffice.

The push button 4 is also provided with a spring return device 14 to return the rocker arm 10 to the midposition position and to produce a feel of step. The spring return device 14 consists of a spring 15 and its mounting accessories 16 and 17. One end of the spring return device 14 is attached to the rocker arm 10 and the other end to the cup-shaped cut-out 3 in the box enclosure 2. The device returns the rocker arm 10 to its midposition when the user loosens his hold of the arm. A stepping button output signal can be generated by the circuit card 6, so that it is not strictly necessary to use a rocker arm construction providing a feel of step. The push button 4 can easily be provided with a mechanism producing a feel of step.

Figure 3:
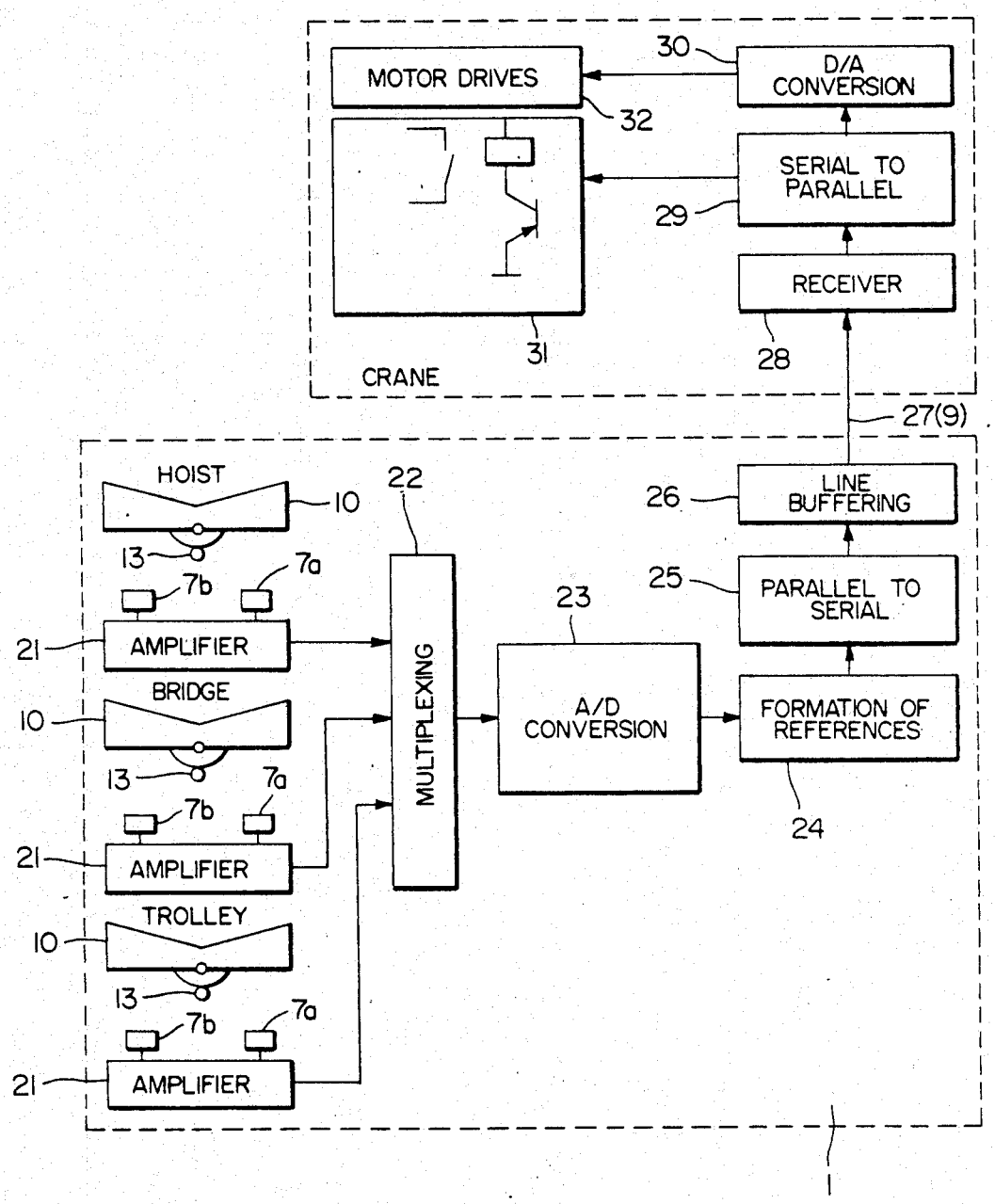

FIG. 3 illustrates the signal processing in the push button box The equipment needed for crane control are the signal processing devices 7*a* and 7*b* and 21–26 in the push button box 1, a signal transmission line 27 and a signal receiver 28 along with its actuators in the electrical control cabinet of the crane (not shown).

Attached to the push button 10, which is of the rocker-arm type, is a magnet 13. Mounted on the circuit card 6 under the push button 10 are two sensor elements 7*a* and 7*b*, e.g. Hall elements, sensitive to the strength of the magnetic field. The sensors 7*a* and 7*b* are so placed on the circuit card 6 that, when the push button 10 is in its rest position, the magnet 13 is located symmetrically relative to the sensors 7*a* and 7*b*, and that the sensors 7*a* and 7*b* are located in the direction of the path of the magnet 13 when it is deviated from the rest position. In the symmetric position (rest position) of the magnet 13, the signals generated by the sensors 7*a* and 7*b* are substantially equal. When the push button 10 is depressed, the magnet 13 attached to it is also deviated from its symmetric position relative to the sensors 7*a* and 7*b*. This results in an increase in the strength of the signal generated by that sensor (e.g. 7*a*) which is now closer to the magnet. Correspondingly, the signal of the other sensor (e.g. 7*b*) becomes weaker because the distance to the magnet 13 has increased. The signals produced by the sensors 7*a* and 7*b* are fed into an amplifier 21 to facilitate further processing of the signals.

For reasons of safety, each control signal needed for the control of a crane is generated in duplicate by providing each push button 10 with two magnets 13, each of which has its own path and its own pair of sensor elements 7*a* and 7*b* on the circuit card 6. Thus, a complete push button 10 comprises two magnets 13 and, correspondingly, four sensor elements 7*a* and 7*b* on the circuit card 6. The assembly of one magnet 13, the two sensor elements 7*a* and 7*b* provided for it and the amplifier unit 21 required by these can be called a signal channel of the push button 10. In crane applications, two such channels are needed for each button.

The signals of all sensor elements 7*a*, 7*b* are amplified by the amplifier unit 21, whereupon a multiplexer unit 22 selects one of these signals in rapid succession for input to an A/D converter 23. The data processing unit typically uses a microprocessor 24, e.g. Intel 80535. The function of the processor is to save the data as required and to check that the signals obtained from the sensor elements 7*a* and 7*b* are acceptable. The signals are checked in two ways:

1. The signals provided by the two sensor elements 7*a*, 7*b* in one signal channel of a push button 10 must be equal in magnitude—with a predetermined accuracy —but opposite in sign.

2. The information provided by each channel of a push button 10 must be in agreement with the information provided by the other channel.

In addition, the processor 24 checks that the signals are within the allowed signal range.

Checking the signals for correctness and acceptability as explained above makes it possible to identify e.g. an extraneous ferromagnetic particle causing interference when it gets into the magnetic field measured by the sensor elements 7*a* and 7*b*. This improves the operational safety of the push button box 1 in the control of a crane.

The momentary button position data produced by the data processing unit 24 are then applied to a parallel-serial converter 25, which converts the position data into serial form. The data processing unit 24 also adds supplementary information to the control signals to enable the receiver 28 to verify that the information was correctly transmitted and to enable the control signals to be directed to the appropriate drives 32. As the transmission line to the crane is generally quite long, the serial signal is amplified by a line amplifier 26 before it is passed to the signal bus 27. The signal bus 27 may be an electrical or an optical data transmission cable 19, a radio transmitter 9 or some other type of wireless transmitter, e.g. an infrared or an induction transmitter.

A receiver unit 28 incorporated in the crane processes the signal obtained from the signal bus 27 to give it the form required for the control of the crane movements. A serial-parallel converter 29 arranges the serial data so as to produce distinct control signals that can be applied to the various crane motor drives 32. The converter 29 also identifies the signals used for verifying whether the data transfer was successful or not. If this verification indicates that an error has occurred in the transmission, suitable means are employed to prevent the use of erroneous signals in the control of the crane. Such means may include e.g. triggering a signal relay 31 to open the main switch of the crane. The signals needed for the control of the crane movements are converted to an analog form by a D/A-converter and then directed as control signals to the appropriate crane motor drives 32.

Besides stepless motion control, the signal transmission procedure described above can also be applied in the transmission of a single-step switch data or multi-switch data or multi-step control signals from the push button box to the crane. These signals can be passed directly to the parallel-serial converter 25. At the receiving end they are available as relay signals 31 controlled by the outputs of the serial-parallel converter 29.

It is obvious to a person skilled in the art that different embodiments of the invention are not restricted to the examples described above, but that they may instead be varied within the scope of the following claims. For example, the invention is also applicable in the case of fixedly mounted push button boxes.

We claim:

1. A method for the generation of control signals in a push bottom box and transmission of said signals for control of a machine, which method comprises:

detecting through a partition, a change in position of at least one push button element in relation to at least one detection element by non-contacting means;

generating a control signal proportional to the detected change in position of said at least one push button; and transmitting said generated control signal to said machine.

2. A method as claimed in claim 1, which method further comprises:

confirming by at least one method the validity of the detected change in position of said at least one push button element prior to generating said control signal.

3. A method as claimed in claim 2, wherein said push button element comprises a magnetic element and said detecting is accomplished by a first and second detector provided for said magnetic element, wherein validity confirmation is obtained by at least one method selected from the group consisting of:

(a) confirming that the signal provided by one said detector is equal in magnitude and opposite in sign to the signal produced by the other of said detectors; and (b) confirming that the signals provided by said first and second detectors are within predetermined signal ranges.

4. A method as claimed in claim 2, wherein said at least one push button element comprises first and second magnetic elements, and said detecting is accomplished by a pair of detectors provided for each of said first and second magnetic elements, wherein validity confirmation is obtained by at least one method selected form the group consisting of:

(a) confirming that the signal provided by a first detector of one said pair of detectors is equal in magnitude and opposite in sign to the signal produced by the other detector of one said pair of detectors;

(b) confirming that the signals provided by said pair of detectors provided for said first magnetic element are in agreement with the signals provided by said pair of detectors provided for said second magnetic element; and (c) confirming that said signals from said pair of detectors provided for said first magnetic element and said signals from said pair of detectors provided for said second magnetic element are within predetermined signal ranges.

5. A method as claimed in claim 1 or 2, wherein said detection step comprises the measurement of the strength of a magnetic field.

6. A method as claimed in claim 1 or 2, wherein said detection step comprises the measurement of a change in direction of a magnetic field.

7. A method as claimed in claim 1 or 2, wherein said signal generating unit and each said push button element are separated by a substantially rigid partition.

8. A method as claimed in claim 1 or 2, wherein said push button box is adapted to produce control signals comprising a plurality of steps.

9. A method as claimed in claim 1 or 2, wherein said push button box is adapted to produce stepless control signals.

10. A push button box for the generation of control signals for a machine and transmission of said signals by a transmission means, comprising at least one push button element, a signal generating unit adapted to receive and confirm the validity of the signals representing the position of said at least one push button element by a non-contacting means, and further adapted to generate control signals proportional to the position of each said push button element, and a partition between each said push button element and said signal generating unit.

11. A push button box as claimed in claim 10, wherein said partition is substantially rigid, and is formed integrally with an enclosure to said push button box.

12. A push button box as claimed in claim 10, wherein each said push button element is provided with a movable part which is at least partially ferromagnetic.

13. A push button box as claimed in claim 12, wherein said movable part comprises two magnets, and said signal generating unit associated therewith is provided with four elements adapted to measure the magnetic field of said magnets, the distance between said magnets and said elements being altered when said push button element is depressed.

14. A push button box for the generation of control signals for a machine and transmission of said signals by a transmission means, comprising:

at least one push button element provided with a movable part which is at least partially ferromagnetic;

a signal generating unit adapted to receive the signals representing the position of said at least one push button element by a non-contacting means, and further adapted to generate control signals proportional to the position of each said push button element, and a substantially rigid partition between each said push button element and said signal generating unit;

wherein said movable part further comprises two magnets; and said signal generating unit associated therewith is provided with four elements adapted to measure the magnetic field of said magnets, the distance between said magnets and said elements being altered when said push button element is depressed.

15. A push button box as claimed in claim 11 or 13, wherein said push button element further comprises a rocker arm mounted on a shaft supported by bearings in at least one bearing housing in said enclosure of said push button box, said enclosure having at least one concave seat adapted to accommodate said rocker arm.

16. A push button box as claimed in claim 15, wherein said push button box comprises a plurality of sections connected at a predetermined angle in non-uniplanar alignment, each said section being adapted to accommodate one push button element, and having a protrusion adapted to facilitate the handgrip of a user of said push button box.

17. A push button as claimed in claim 15, wherein each said push button element is further provided with a spring return device adapted to return said rocker arm to a central position.

18. A push button box as claimed in claim 10 or 14, wherein said transmission means is a cable.

19. A push button box as claimed in claim 10 or 14, wherein said transmission means is a wireless transmitter.

* * * * *